US005904134A

United States Patent [19]

Denbow

[11] Patent Number: 5,904,134

[45] Date of Patent: May 18, 1999

[54] BOW STABILIZER

[76] Inventor: Dan Denbow, 603 Circle Ridge Dr., Buchanan, Mich. 49107

[21] Appl. No.: 08/892,816

[22] Filed: Jul. 15, 1997

[51] Int. Cl.[6] ..... F41B 5/20

[52] U.S. Cl. ..... 124/89

[58] Field of Search ..... 124/89

[56] References Cited

U.S. PATENT DOCUMENTS

| | | | |
|---|---|---|---|
| 3,804,072 | 4/1974 | Izuta . | |
| 4,054,121 | 10/1977 | Hoyt, Jr. | 124/89 |
| 4,324,222 | 4/1982 | Gasser | 124/89 |
| 4,553,522 | 11/1985 | Topping | 124/89 |
| 4,556,042 | 12/1985 | Izuta | 124/89 |
| 5,044,351 | 9/1991 | Pfeifer | 124/89 |
| 5,205,272 | 4/1993 | Boyer | 124/89 |
| 5,370,104 | 12/1994 | Neie | 124/89 |
| 5,471,969 | 12/1995 | McDonald | 124/89 |
| 5,535,731 | 7/1996 | Webster | 124/89 |
| 5,615,664 | 4/1997 | McDonald | 124/89 |
| 5,630,407 | 5/1997 | Gasser | 124/89 |

OTHER PUBLICATIONS

Pro Medalist T/D, Archery, Mar. 1973.
Straight Arrow article, 1976.

*Primary Examiner*—John A. Ricci
*Attorney, Agent, or Firm*—Barnes & Thornburg

[57] ABSTRACT

A bow stabilizer according to the present invention includes a body for attachment to the bow which defines an internal chamber. A guide rod is supported by the body within the internal chamber. The guide rod carries a movable part and a pair of biasing members arranged to apply opposing biasing forces to the movable part. A pair of stabilizer arms are removably connected to the movable part and extend external to the internal chamber through openings in the body. Each stabilizer arm carries a removable stabilizer weight. The movable part moves forwardly and rearwardly along the guide rod against the biasing forces of the biasing members, carrying the stabilizer arms forwardly and rearwardly within their respective openings, to counteract the bow vibration created by launching an arrow.

40 Claims, 6 Drawing Sheets

BOW STABILIZER

BACKGROUND AND SUMMARY OF THE INVENTION

The present invention relates generally to archery bow accessories and specifically to a stabilizer attachment for an archery bow.

An archery bow moves or vibrates in response to the forces generated upon release of the bow string from its drawn position to fire an arrow. According to well known principles of physics, as the string and arrow move toward the target, the bow tends to move in the opposite direction toward the archer. Similarly, when the bow string reverses direction immediately following departure of the arrow, the bow tends to move in the direction of the target. Such reactive forces have a tendency to cause the bow to tip slightly upwardly and downwardly since the center of mass of the bow is typically located above the archer's grip on the riser. Obviously, any tipping of the bow during release of the arrow undesirably deflects the arrow from its intended trajectory toward the target. Thus, it is desirable to provide an archery bow stabilizer to counteract and minimize the undesirable effects of these physical reactive forces.

One embodiment of the present invention provides an archery bow stabilizer which includes a hollow body adapted for attachment to a standard mounting location provided on the forward facing surface of a bow riser so as to project from the riser toward the target. The body houses a guide rod which also extends toward the target. A movable part is biased into a resting position on the guide rod by a pair of opposing springs. A pair of stabilizer arms connected to the movable part extend outwardly from the movable part through openings in the outer wall of the hollow body. The stabilizer arms are removable so that a variety of paired arms of different weights and sizes may be used interchangeably. The ends of the stabilizer arms are threaded or otherwise adapted to removably receive stabilizer weights.

Before the drawn bow string is released, the movable part is substantially stationary in its resting position on the guide rod under the opposing biasing forces of the springs. When the string is released, the movable part responds to the reactive forces exerted on the bow by moving forward and backward on the guide rod against the biasing force of one or the other of the pair of springs, carrying the stabilizer arms with it through their respective outer wall openings, thereby damping the overall vibrational movement of the bow.

According to another embodiment of the present invention, the movable part includes extensions which project through the outer wall openings to removably receive the stabilizer arms. Additionally, the stabilizer arms are hollow to concentrate the mass of the arms at the stabilizer weights disposed at the distal ends of the arms.

Other features of the present invention will be apparent upon consideration of the following description of exemplary embodiments and the accompanying drawings.

DETAILED DESCRIPTION OF EMBODIMENTS OF THE INVENTION

The embodiments described herein are not intended to be exhaustive or to limit the invention to the precise forms disclosed. Rather, the embodiments selected for description are disclosed so that others skilled in the art may utilize their teachings.

Figure 1:
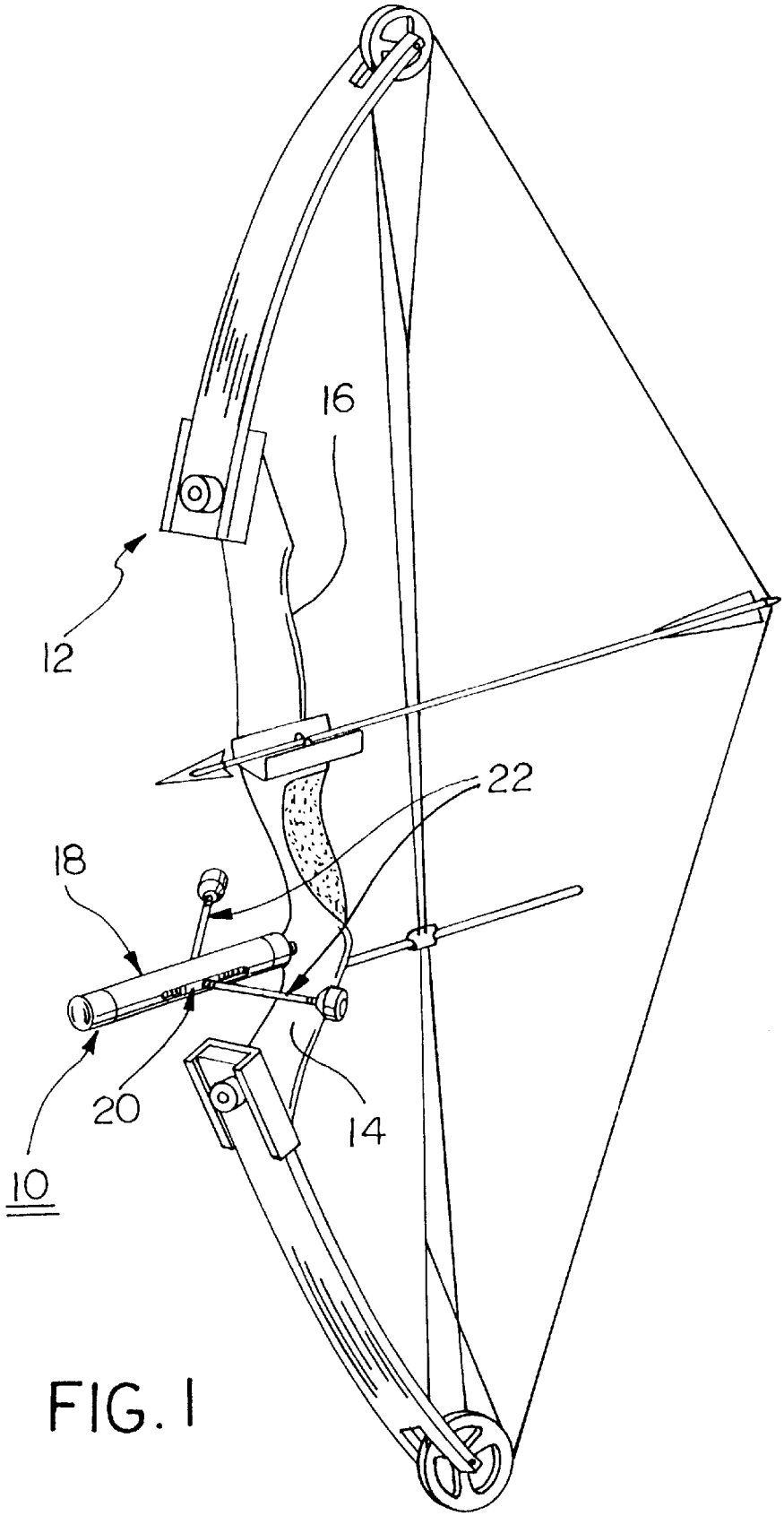
FIG. 1 is a perspective view of an archery bow stabilizer according to the present invention mounted to an archery bow.

FIG. 1 shows an archery bow stabilizer 10 according to the present invention mounted to an archery bow 12 at a standard mounting bore (not shown) on the forward facing surface 14 of the bow riser 16. Bow stabilizer 10 generally includes a body or housing 18 which extends from bow riser 16 toward the target and houses a movable part 20 with a pair of externally extending stabilizer arms 22.

Figure 2:
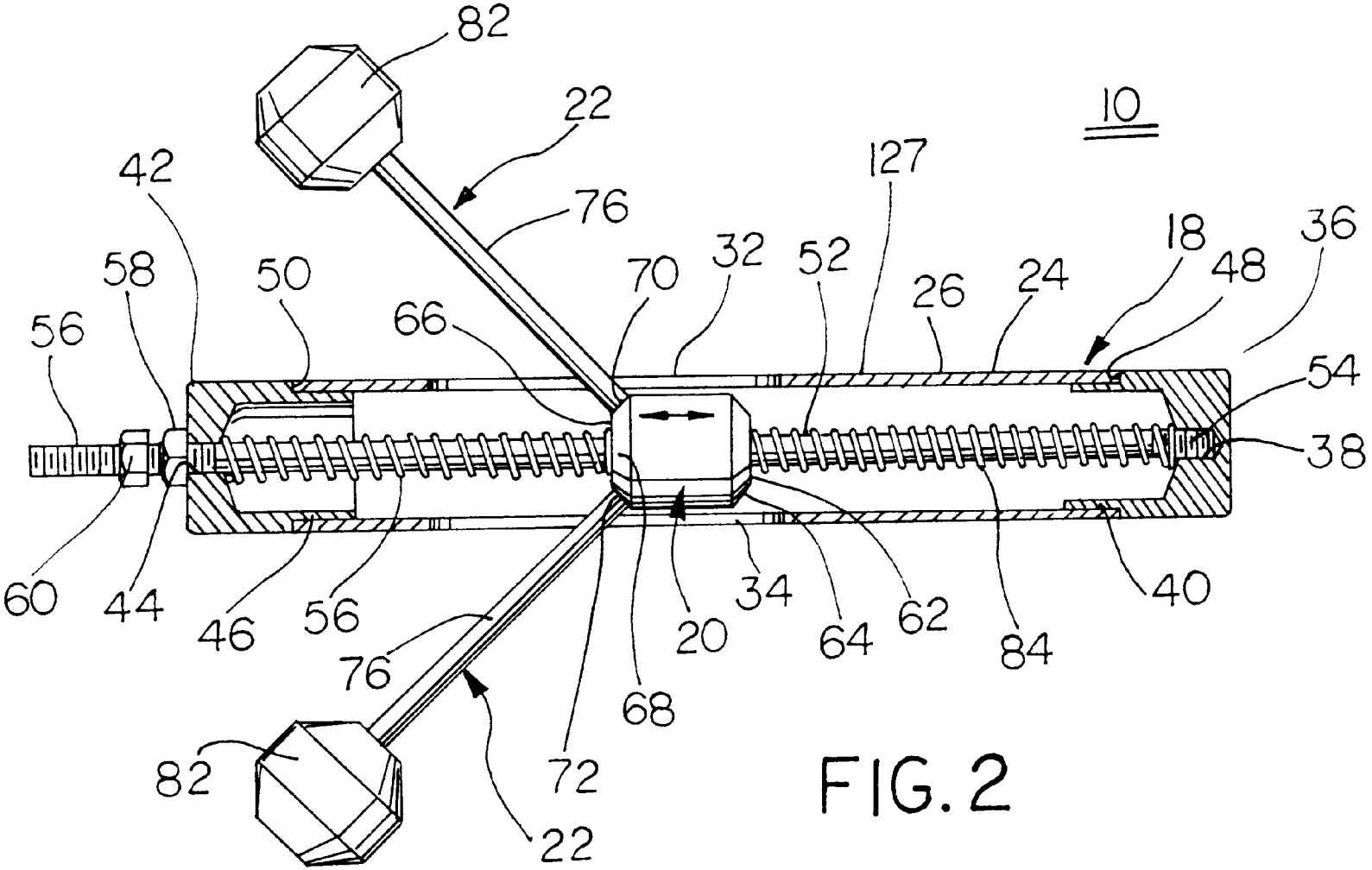
FIG. 2 is a top plan view, partly in section, of the bow stabilizer of FIG. 1.
Figure 3:
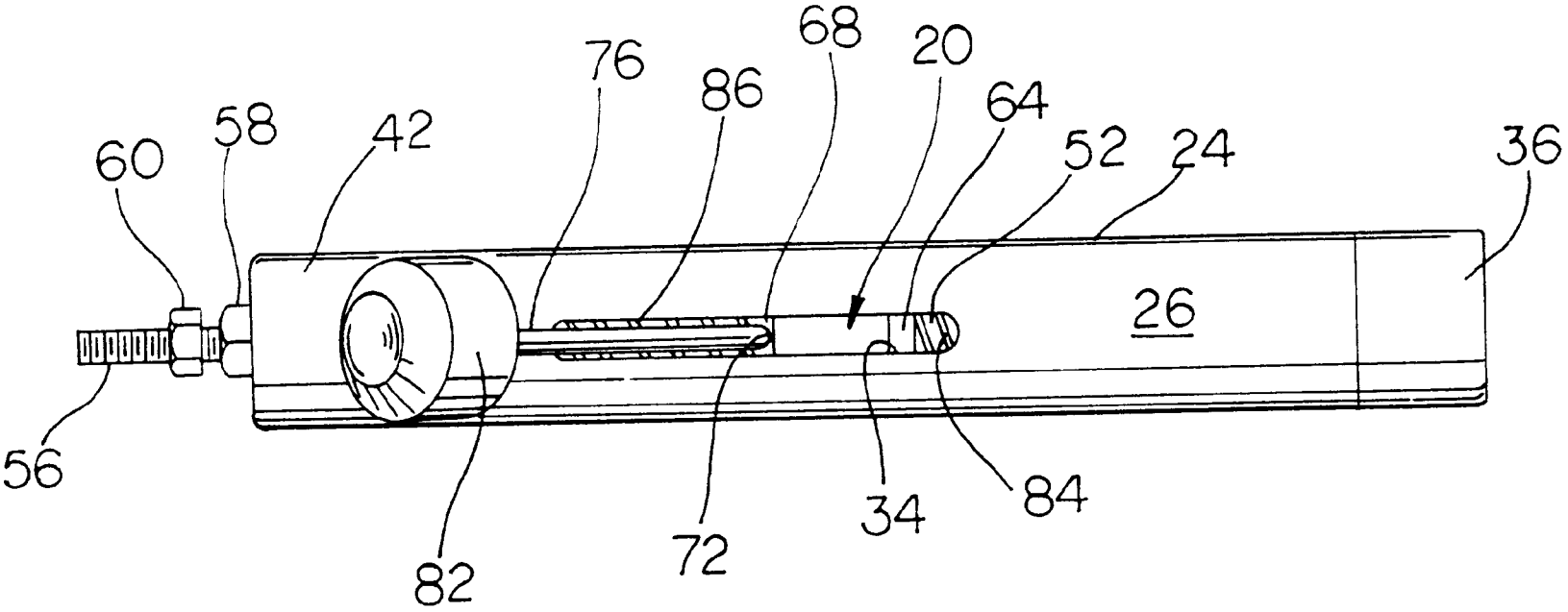
FIG. 3 is a side elevational view of the bow stabilizer of FIG. 1.
Figure 4:
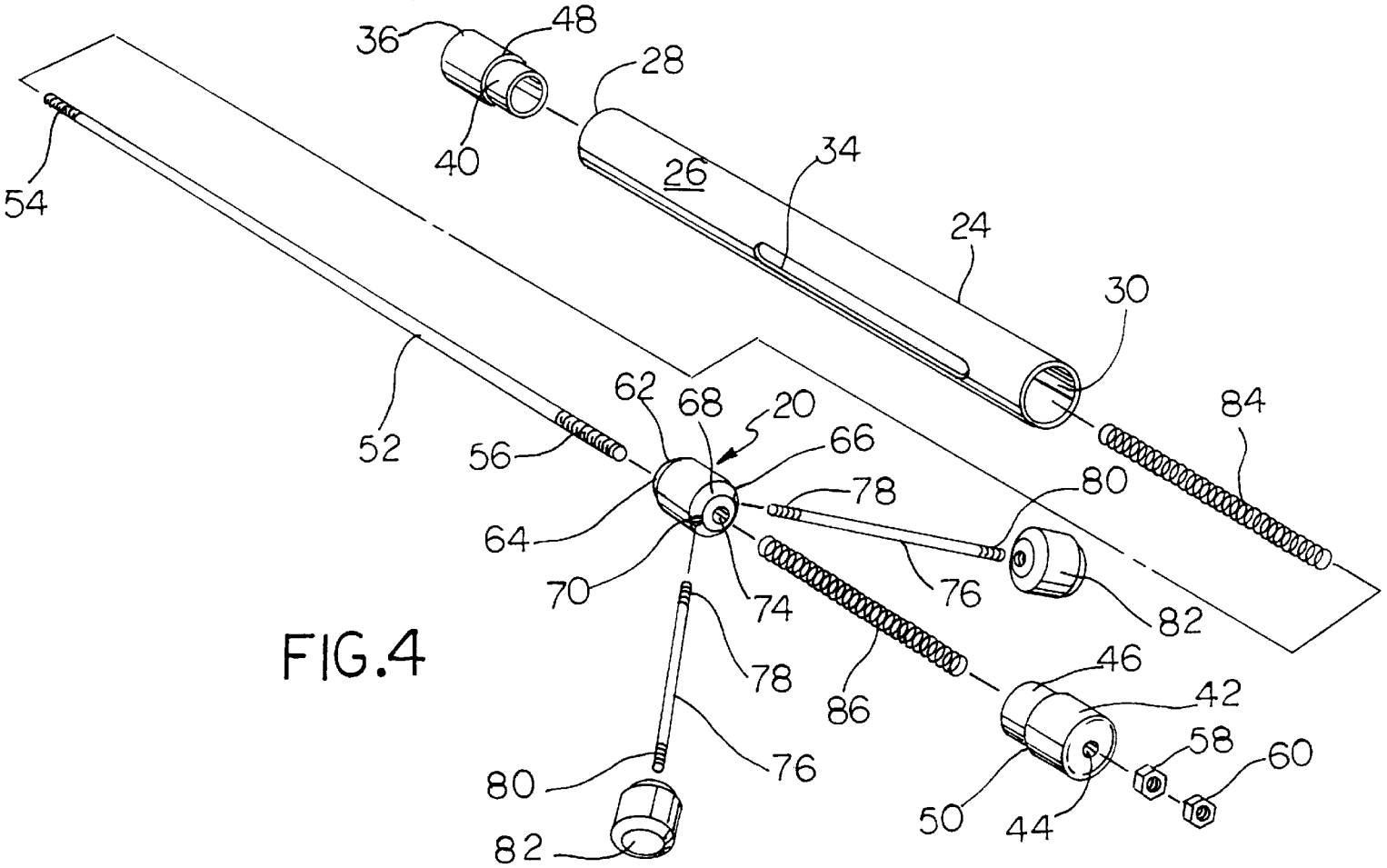
FIG. 4 is an exploded perspective view of the bow stabilizer of FIG. 1.

As best shown in FIGS. 2 through 4, housing 18 includes a tube 24 with an outer wall 26 and a pair of ends 28, 30 which define an internal chamber 27, and a pair of aligned openings or slots 32, 34. Housing 18 further includes an outer cap 36 with a central bore 38 and a reduced diameter portion 40, and an inner cap 42 with a central bore 44 and a reduced diameter portion 46. Each reduced diameter portion 40, 46 is bordered by a circumferential shoulder 48, 50.

A guide rod 52 with threaded ends 54, 56 is supported within housing 18 between outer cap 36 and inner cap 42. Threaded end 54 is screwed into outer cap central bore 38, and threaded end 56 extends through inner cap central bore 44. A nut 58 is tightened onto threaded end 56 against inner cap 42, thereby drawing the caps onto tube 24 so that circumferential shoulders 48, 50 seat against tube ends 28, 30, respectively. Threaded end 56 is turned into the bow riser mounting bore (not shown) and locked in place by lock nut 60, thereby securing bow stabilizer 10 to bow riser 16.

In this embodiment, the movable part 20 is a substantially cylindrical weight with an outer diameter which is slightly smaller than the inner diameter of housing tube 24. An axial opening 74 extends through movable part 20 to receive guide rod 52. Opening 74 is sized to permit movement of movable part 20 along the guide rod.

The outer end 62 of movable part 20 has a chamfered edge 64. The inner end 66 has a chamfered edge 68 which includes a pair of threaded bores 70, 72 to receive the stabilizer arms 22. Each stabilizer arm 22 includes a shaft 76 with threaded ends 78, 80. The first ends 78 of shafts 76 are threaded for removable insertion into bores 70, 72. The second ends 80 of shafts 76 are also threaded to receive internally threaded stabilizer weights 82, thereby permitting substitution of stabilizer weights of different sizes and shapes. Of course, stabilizer arms 22 and stabilizer weights 82 need not be symmetric in shape or weight. When bow stabilizer 10 is assembled, stabilizer arms 22 extend from movable part 20 through aligned openings 32, 34 in tube 24 and stabilizer weights 82 are offset from movable part 20.

As best shown in FIG. 2, a pair of biasing members 84, 86 are coiled about guide rod 52. Outer member 84 extends between outer cap 36 and end 62 of movable part 20. Inner member 86 similarly extends between inner cap 42 and end 66 of movable part 20. The members are in a state of partial compression, thereby exerting opposing biasing forces on ends 62, 66. Consequently, movable part 20 is biased into a resting position on guide rod 52 when the biasing forces exerted by biasing members 84, 86 reach equilibrium. Movable part 20 remains substantially in its resting position until an arrow is released from bow 12 as is described in greater detail below.

In the embodiment shown, biasing members are springs, however, one skilled in the art could readily substitute other devices for springs 84, 86 or modify the configuration or number of biasing members to accomplish the biasing function. For example, a single spring could be situated within tube 24 and coupled to movable part 20 such that the spring biases movable part 20 into its resting position.

In operation, archery bow stabilizer 10 of the present invention counteracts the forces exerted on archery bow 12 upon release of an arrow by absorbing energy imparted to the bow. When bow 12 is fully drawn just prior to release of an arrow (as shown in FIG. 1), movable part 20 is biased in its resting position on guide rod 52 by springs 84, 85. Stabilizer arms 22 extend substantially through the center of openings 32, 34 in housing tube 24. Openings 32, 34 are elongated to accommodate the forward and rearward movement of arms 22 as bow stabilizer 10 responds to the reactive forces generated upon release of the bow string. Movable part 20 is disposed forward of stabilizer arms 22, offset from the center of openings 32, 34.

When released, the bow string travels through the operating plane of the bow and propels the arrow forward, thus creating a rearward reactive force in bow 12. The bow carries housing 18 and guide rod 52 in a rearward direction in the operating plane. According to commonly known principles of physics, movable part 20 moves relative to guide rod 52 against the biasing force of outer biasing member 84. Stabilizer arms 22 travel forwardly within openings 32, 34 as movable part 20 moves along guide rod 52. Accordingly, stabilizer weights 82 move within planes offset from the operating plane of the bow. When the bow string reverses direction, shortly after the arrow is launched, similar forces tend to cause bow 12 to move forwardly to oppose the rearwardly directed forces of the bow string. The biasing force of outer biasing member 84, however, urges movable part 20 and stabilizer arms 22 rearwardly to counteract the potential motion of the bow. The responsive forward and rearward motion of movable part 20 and stabilizer arms 22 damps the bow riser vibration which could otherwise affect the accuracy of the arrow's trajectory.

As should be apparent from the foregoing, the responsiveness of and the vibrational damping provided by archery bow stabilizer 10 is largely dependant upon the resiliency of springs 84, 86 and the size, shape, and weight of movable part 20, stabilizer arms 22 and stabilizer weights 82. As each of these components is removable, the performance of bow stabilizer 10 can be adjusted depending upon shooting conditions and the bow set-up (i.e., the tension of the bow string, the physical characteristics of the bow, the action of the string cams, the weight of the arrow, etc.).

Figure 5:
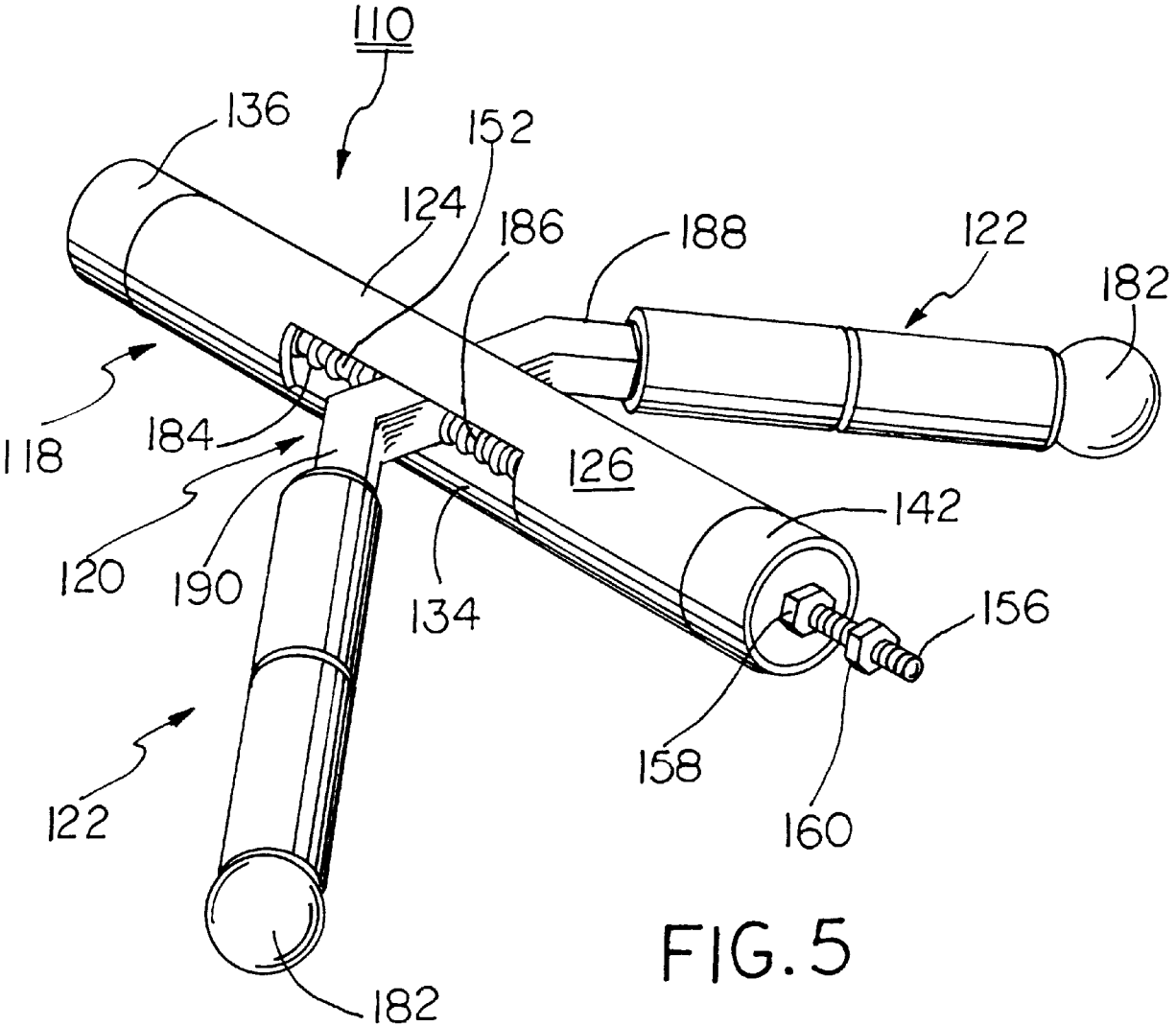
FIG. 5 is a perspective view of another embodiment of the archery bow stabilizer of the present invention.
Figure 6:
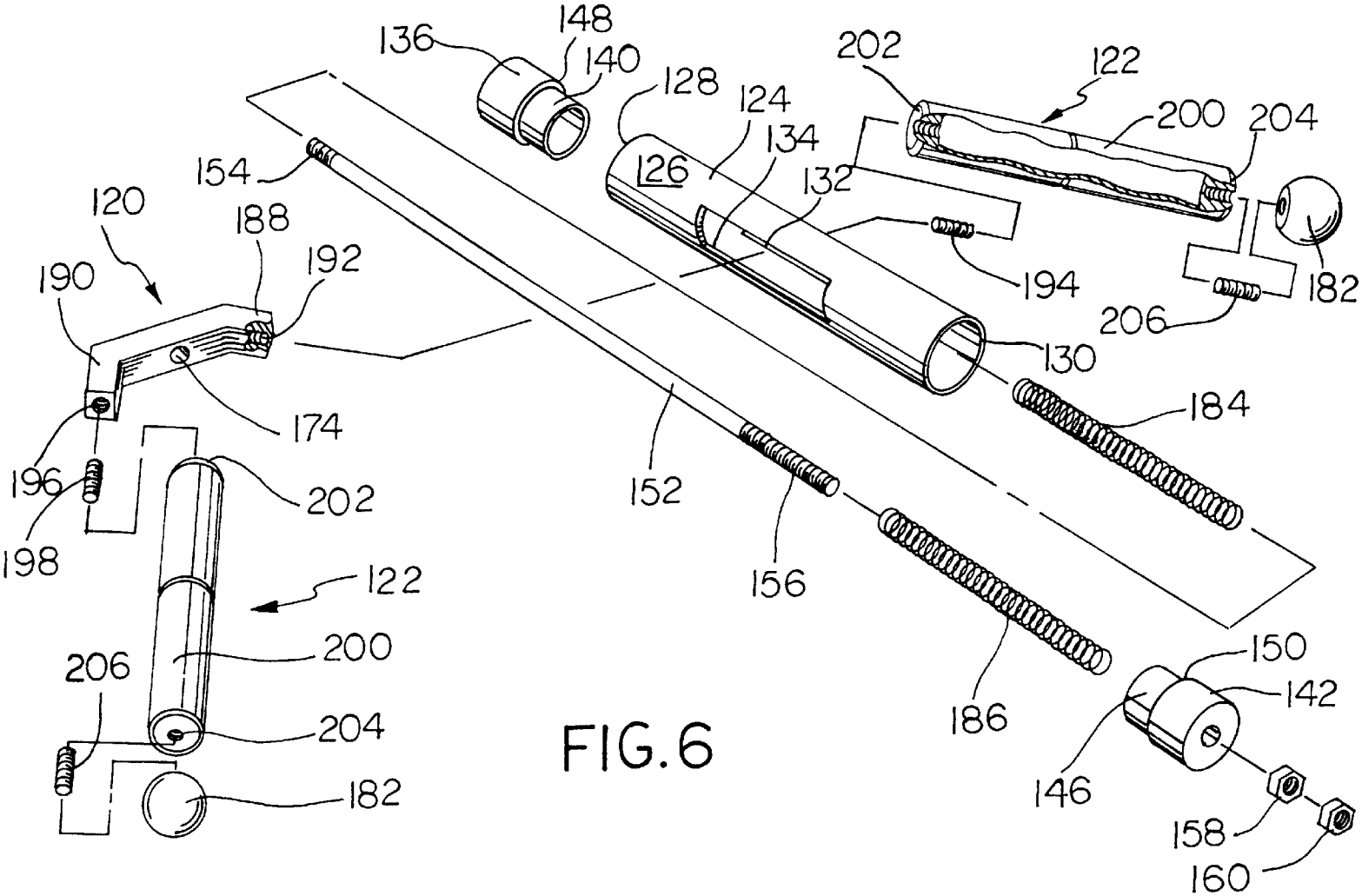
FIG. 6 is an exploded perspective view, partly in section, of the bow stabilizer of FIG. 5.

FIGS. 5 and 6 illustrate another embodiment of the bow stabilizer of the present invention. For convenience, like components have retained their reference designations, except that the numbers have been increased by 100. In this embodiment, movable part 120 extends laterally from guide rod 152 through slots 132, 134. Movable part 120 includes extensions 188, 190 which project symmetrically through openings 132, 134, respectively, at an angle relative to guide rod 152. Extension 188 includes a threaded bore 192 which receives a connector bolt 194. Extension 190 similarly includes bore 196 which receives bolt 198.

Stabilizer arms 122 include hollow tubes 200, each having threaded ends 202, 204, stabilizer weights 182, and connector bolts 206. Connector bolts 194, 198 secure tubes 200 to movable part 120, and connector bolts 206 secure stabilizer weights 182 to tubes 200.

While this invention has been described as having exemplary embodiments, this application is intended to cover any variations, uses, or adaptations of the invention using its general principles. Further, this application is intended to cover such departures from the present disclosure as come within the known or customary practice within the art to which it pertains. The spirit and scope of the invention are to be limited only by the terms of the appended claims.

What is claimed is:

1. A bow stabilizer, comprising:

a housing having an internal chamber;

a rod located at least partially within the internal chamber;

a movable part carried by the rod;

a biasing member situated to apply opposing biasing forces to the movable part; and a pair of stabilizer arms connected to the movable part extending external to the housing.

2. The bow stabilizer of claim 1 wherein the rod extends through the internal chamber substantially within an operating plane of the bow.

3. The bow stabilizer of claim 1 wherein the stabilizer arms are removably attached to the movable part.

4. The bow stabilizer of claim 1 wherein each of the stabilizer arms includes a removable stabilizer weight.

5. The bow stabilizer of claim 1 wherein the housing is cylindrical in shape with a circumferential wall and a pair of ends defining the internal chamber, the rod extending between the pair of ends within the internal chamber.

6. The bow stabilizer of claim 1 wherein the biasing member includes a pair of helical springs disposed about the rod between the movable part and the housing.

7. The bow stabilizer of claim 6 wherein the movable part includes a center opening for receiving the rod, a first end for contacting one of the springs, and a second end for contacting the other of the springs.

8. The bow stabilizer of claim 1 wherein the stabilizer arms extend from the movable part through a pair of openings in the housing.

9. The bow stabilizer of claim 8 wherein the housing openings are slots.

10. The bow stabilizer of claim 8 wherein the biasing member biases the movable part into a resting position in which the stabilizer arms are substantially centered within the openings.

11. The bow stabilizer of claim 1 wherein the movable part includes a pair of extensions which project through a pair of openings in the housing.

12. The bow stabilizer of claim 11 wherein the stabilizer arms are connected to the movable part extensions.

13. A bow stabilizer, comprising:

a housing having an internal chamber;

a movable part disposed within the internal chamber;

guide means located at least partially within the internal chamber for guiding the movable part between a first position and a resting position;

biasing means for biasing the movable part into the resting position; and stabilizer means connected to the movable part and extending external to the housing for stabilizing the bow;

whereby the movable part and stabilizer means move relative to the guide means against the biasing force of the biasing means to counteract the bow vibration created by launching an arrow.

14. The bow stabilizer of claim 13 wherein the stabilizer means extends through an opening in the housing.

15. The bow stabilizer of claim 13 wherein the stabilizer means is removably attached to the movable part.

16. The bow stabilizer of claim 13 wherein the stabilizer means carries a removable stabilizer weight.

17. An apparatus for stabilizing an archery bow, comprising:

a body having an end adapted for connection to the bow;

a weight supported by the body for forward and rearward motion within an operating plane of the bow about a resting position, the weight including an offset portion disposed outwardly from the body outside the bow operating plane;

a biasing member operably disposed between the body and the weight for biasing the weight into the resting position; and a guide rod mounted to the body, the weight being movable along the guide rod.

18. The bow stabilizer of claim 17 wherein the biasing member includes a first helical spring coiled about the guide rod in compression between the body and one end of the weight, and a second helical spring coiled about the guide rod in compression between the body and another end of the weight, the springs thereby applying opposing biasing forces to the weight.

19. An apparatus for stabilizing an archery bow, comprising:

a body having an end adapted for connection to the bow;

a weight supported by the body for forward and rearward motion within an operating plane of the bow about a resting position, the weight including an offset portion disposed outwardly from the body outside the bow operating plane;

a biasing member operably disposed between the body and the weight for biasing the weight into the resting position; and wherein the body is a tube, the weight being supported within the tube.

20. The bow stabilizer of claim 19 wherein the weight offset portion extends through an opening in the tube, the opening being formed to accommodate the forward and rearward movement of the offset portion.

21. The bow stabilizer of claim 20 wherein the opening is a slot.

22. A bow stabilizer, comprising:

a housing having an internal chamber;

a rod located at least partially within the internal chamber;

a movable part carried by the rod and movable relative to the rod into and out of a resting position;

a biasing member situated to apply a biasing force to the movable part in order to bias the movable part toward said resting position; and at least one weight connected to the movable part.

23. The bow stabilizer of claim 22 wherein the rod extends through the internal chamber substantially within an operating plane of the bow.

24. The bow stabilizer of claim 22 wherein the at least one weight is removably attached to the movable part.

25. The bow stabilizer of claim 22 wherein the housing is cylindrical in shape with a circumferential wall and a pair of ends defining the internal chamber, the rod extending between the pair of ends within the internal chamber.

26. The bow stabilizer of claim 22 wherein the biasing member includes a pair of helical springs disposed about the rod between the movable part and housing.

27. The bow stabilizer of claim 22 wherein the at least one weight extends from the movable part through an opening in the housing.

28. The bow stabilizer of claim 27 wherein the housing opening is a slot.

29. The bow stabilizer of claim 27 wherein the biasing member biases the movable part into a resting position in which at least one weight is substantially centered within the housing opening.

30. The bow stabilizer of claim 22 wherein the movable part includes a pair of extensions which project through a pair of openings in the housing.

31. The bow stabilizer of claim 30 wherein the at least one weight is connected to at least one of the movable part extensions.

32. A bow stabilizer, comprising:

a housing having an internal chamber;

a rod located at least partially within the internal chamber;

a movable part carried by the rod, the movable part including a center opening for receiving the rod;

a biasing member situated to apply a biasing force to the movable part, the biasing member including a pair of helical springs disposed about the rod between the movable part and housing, the movable part including a first end for contacting one of the springs, and a second end for contacting the other of the springs; and at least one weight connected to the movable part.

33. An apparatus for stabilizing an archery bow, comprising:

a rod having a first end and a second end;

a first weight being movable along the rod within an operating plane of the bow about a resting position;

a second weight connected to the first weight and disposed outwardly from the rod outside the bow operating plane; and a biasing member having one end contacting one of the first and second ends of the rod and another end contacting the first weight.

34. The apparatus of claim 33 wherein the biasing member includes a spring.

35. The apparatus of claim 33 wherein the second weight includes a pair of stabilizer arms, each of the stabilizer arms having an end carrying a removable stabilizer weight.

36. The apparatus of claim 33 wherein the biasing member includes a first helical spring coiled about the rod in compression between the first end of the rod and one end of the first weight, and a second helical spring coiled about the rod in compression between the second end of the rod and another end of the first weight, the springs thereby applying opposing biasing forces to the first weight.

37. The apparatus of claim 33 wherein further comprising a tube, the rod extending through the tube, the first weight being supported within the tube.

38. The apparatus of claim 37 wherein the second weight extends through an opening in the tube, the opening being formed to accommodate movement of the offset portion.

39. The apparatus of claim 38 wherein the opening is a slot.

40. An apparatus for stabilizing an archery bow, comprising:

a rod having a first end and a second end;

a first weight being movable along the rod;

a second weight connected to the first weight, the second weight being laterally offset from the first weight relative to the rod; and a biasing member having one end supported in a fixed position relative to the rod and another end contacting the first weight.

* * * * *